US005135010A

United States Patent [19]

Fan

[11] Patent Number: 5,135,010

[45] Date of Patent: Aug. 4, 1992

[54] HERBAL SMOKING MATERIALS

[76] Inventor: Sophie S. M. Fan, 21 Glenwood Rd., Millwood, N.Y. 10546

[21] Appl. No.: 743,165

[22] Filed: Aug. 9, 1991

[51] Int. Cl.[5] ..... A24B 15/18; A24D 1/18

[52] U.S. Cl. ..... 131/359; 131/369

[58] Field of Search ..... 131/359, 369

[56] References Cited

PUBLICATIONS

"The Sinister Garden" published by Wyeth Labs. N.Y., N.Y. in 1966 (p. 22).

The American Heritage Dictionary Second College Edition, p. 717—published 1976.

*Primary Examiner*—V. Millin

*Attorney, Agent, or Firm*—Charles J. Herron

[57] ABSTRACT

A smoking material that comprises a dried preparation of *Laurus nobilis* or *Nelumbo garetin* or their combination, particularly including their leaves. This smoking material can be used alone or in combination with various herbal extracts, honey and can be combined into mixtures with smoking tobacco, if desired. It is made by a process in which plant parts, particularly the leaves, are roasted for at least about eight hours at a temperature of about 100° C. to 120° C. The smoking material, when smoked, is similar in taste to tobacco, but has extremely low concentrations of the harmful components present in tobacco and, in particular, is free of nicotine and its metabolites.

20 Claims, No Drawings

HERBAL SMOKING MATERIALS

BACKGROUND OF THE INVENTION

1. Field of the Invention

The present invention relates to the field of smoking materials, and particularly to such materials that can be used as substitutes for or in combination with tobacco smoking materials and are not only nicotine-free but also have fewer of the other constituents of tobacco smoking materials that are harmful to the health of the user.

2. Brief Description of the Prior Art

Tobacco substitutes have been the subject of investigation for the several ways in which tobacco has conventionally been used. For example, relating to chewable or snuff-type compositions, see U.S. Pat. Nos. 3,877,468; 4,696,315; and 4,817,640. Most of the attention in this regard has been directed at alternatives to conventional tobacco smoking materials in the forms of cigarettes, cigars and pipe tobacco.

Grigg et. al., U.S. Pat. No. 4,600,025, disclose a cigarette which consists of an inert combustible substrate and a nicotine-substitute-effective amount of either 2-methyl-5-(pyrrolidinomethyl) thiazole or 2-methyl-5-(piperidinomethyl) thiazole.

Honeycutt, U.S. Pat. No. 4,765,348 discloses a non-combustible simulated cigarette inhaler device formed of a hollow cylinder, simulating a cigarette, that has within it a first section of air-permeable material impregnated with a nicotine free base material and a second portion impregnated with an acid which is reactive with the free base to form a salt having a pH in the range of 5–7. Examples of such acids are 2-butenoic acid, 2-methyl-2-butenoic acid, isocaproic, caproic and caprylic acids. The device delivers volatilizable nicotine to the user as a free base, rather than relying on the combustion of tobacco.

SUMMARY OF THE INVENTION

The present invention provides a smoking material that is not only nicotine-free but also has fewer of the other constituents of tobacco smoking materials that are harmful to the health of the user.

The composition comprises a dried preparation suitable for smoking of a plant selected from the group consisting of a Laurus species, particularly *Laurus nobilis* and a Nelumbo species, particularly *Nelumbo garetin*, or combinations thereof. Preferably the major components of the plant used in the dried preparations are the leaves. The preferred proportions for the combinations are about 1:1 to about 4:1 of Laurus to Nelumbo.

Other preparations, usually in the form of herbal extracts, that can also be included with either or both of the above ingredients include those made from, for example, *Polygonum Multiforum Thunb, Schisandra Chinesis Baill, Salvia Miltiorrhiza,* ginseng, *Umbilicaria Esculenta Minks, Atractylodes Nacrocephala Koidz, Lycium Chinense Mill, Astragalus Membranaceus* and honey.

In another aspect, the preparation can be made into mixtures with tobacco smoking materials, if desired.

In another aspect, the invention provides a process for making the above tobacco substitute products. The process comprises roasting the plant leaves for at least eight hours at a temperature from about 100° C. to about 120° C.

The smoking material of the invention, when smoked, produces extremely low concentrations of harmful combustion components, particularly being free of nicotine and its byproducts, thus overcoming in great part the major drawback of prior art products, while it also provides the user with a taste that is similar to tobacco.

DETAILED DESCRIPTION OF PREFERRED EMBODIMENTS

The present invention provides smoking materials that contain, both before and after combustion, extremely low concentrations of harmful components that are present in tobacco. Their taste, however, when smoked is similar to that of tobacco. The smoking materials of the invention are prepared from natural herbs and plants and also contain nutrients beneficial to the user.

The major ingredients of the smoking materials of the present invention are dried preparations of Laurus species, particularly *Laurus nobilis* plant leaf, and Nelumbo species, particularly *Nelumbo garetin* plant leaf. Each can be used alone or they can be used in combinations of varying proportions. Preferred proportions for their combination are from about 1:1 to about 4:1.

The principal ingredients are processed from the original plant into the smoking materials of the invention in a manner much like the way raw tobacco leaves are made into smoking tobacco preparations, including loose chopped pipe tobacco, cigarettes or cigars. However, the *Laurus nobilis* and *Nelumbo garetin* ingredients used in the present invention are subjected to a roasting process for at least about 8 hours at a temperature of from about 100° C. to about 120° C. The roasting process transforms the plant protein into amino acids and removes a portion of the essential oils in the plant, thereby providing the resulting product with an attractive aroma and taste.

The invention also provides for smoking mixtures of the above composition and a tobacco-containing smoking composition. In such mixtures, the herbal and tobacco smoking materials are present in a weight ratio of about 10:1 to 1:10, preferably about 5:1 to 1:5. As when used free of tobacco, the herbal smoking materials comprise a dried preparation of Laurus species, particularly *Laurus nobilis*, Nelumbo species, particularly *Nelumbo garetin*, or a combination or mixture of them.

The addition to the composition of one or more herbal extract enhances the energy level and sense of vitality of the user. Such ingredients can include, for example, extracts from *Polygonum Multiforum Thunb, Schisandra Chinensis Baill, Salvia Miltiorrhiza,* ginseng, *Umbilicaria Esculenta Minks, Atractylodes Macrocephala Koidz, Lycium Chinense Mill, Astragalus Membranaceus.* Honey can also be added for this purpose and to add to the taste and aroma of the preparation.

The additional ingredients noted above are extracted with ethanol or other appropriate extraction solvents and sprayed onto the preparations of *Laurus nobilis* and *Nelumbo garetin* prior to final drying and packaging in cigarette paper or otherwise. These additional ingredients usually are present in amounts of about 0.1 to 10 percent (w/w), preferably less than 1 percent (w/w), of the composition.

The following examples provide further illustration of the invention.

EXAMPLE 1

The smoking material of the invention has been packaged in cigarette paper to form individual cigarettes similar in appearance to commercially available tobacco cigarettes. Two types of cigarette in accordance with the invention were prepared, one containing only *Laurus nobilis* (cigarette A) and the other containing only *Nelumbo garetin* (cigarette B). These were then chemically analyzed in comparison with a commercially available Marlboro brand tobacco cigarette (cigarette C). As described in this example, each cigarette was analyzed for its content of nitrogen dioxide, sulfur dioxide, phenol, benzopyrene and free radicals.

Analytical Procedure

The smoking material preparations to be used were dried in a dessicator for several days and then weighed. They were then burned in a combustion chamber having an oxygen supply and the gases were drawn off through three absorption tubes, connected in series. Each absorption tube contained 10 ml of absorption solution. The absorption solution was 0.1N NaOH for the nitrogen dioxide and sulfur dioxide determinations, benzene for the phenol determination, cyclohexane for the benzopyrene determination, and distilled water and cyclohexane for the determination of free radicals. Once combustion was completed, the series of three absorption solutions for each determination and each type of cigarette were combined. The cyclohexane absorption solution for the benzopyrene determination was concentrated from the original combined volume of 30 ml to a final volume of 0.5 ml. Each absorption solution, without having been exposed to combustion or resulting gases was analyzed concurrently to serve as a blank.

The sulfur dioxide and nitrogen dioxide determinations were performed using a Dionex 20101 HPLC-LC system (Dionex Corp.), fitted with a 10-$As_3$ column and a conductivity detector. The mobile phase used contained 0.0022M $Na_2CO_3$ and 0.0028M $NaHCO_3$, the flow rate was 2 ml/minute and the injection volume was 50 ul.

The phenol determination was performed using a Perkin-Elmer Sigma-1 gas chromatography system (Perkin-Elmer Corp.), fitted with a FFAP column (0.1% carbopack C) and a FID detector. The injection volume was 1 ul. The benzopyrene determination was performed using a Hitachi 650-65 fluorescence spectrophotometer (Hitachi, Inc.). The determination of free radicals was performed using a Brucker ER-200D Electron Paramagnetic Resonance Spectrometer (Brucker GmbH, W. Germany).

Results

1. $NO_2$ and $SO_2$.

Cigarette A (0.33 g) produced 4.84 ug $NO_2$. Cigarette B (0.29 g) produced 55.4 ug $NO_2$. Cigarette C (0.5 g) produced 8.33 ug $NO_2$. When the weight of the cigarette is normalized to 1.0 g, the relative amounts of $NO_2$ produced were 14.67 ug/g (cigarette A), 191 ug/g (cigarette B) and 16.67 ug/g (cigarette C), respectively.

Cigarettes A and B both produced no detectable amount of $SO_2$. Cigarette C, normalized to 1.0 g, produced 2.0 ug $SO_2$.

2. Phenol

Cigarettes A (0.18 g) and B(0.22 g) both produced no detectable amount of phenol. Cigarette C (0.5 g) produced 20.0 ug phenol.

3. Benzopyrene

Cigarette A (0.94 g) produced 0.014 ug benzopyrene. Cigarette B (1.08 g) produced 0.003 ug benzopyrene. Cigarette C (1.0 g) produced 0.018 ug benzopyrene. When the weight of the cigarette is normalized to 1.0 g, the relative amounts of benzopyrene produced were 0.0149 ug/g (cigarette A), 0.0028 ug/g (cigarette B) and 0.0110 ug/g (cigarette C), respectively.

4. Free Radicals

For cyclohexane absorption of free radicals, cigarettes A (0.90 g) and B (1.08 g) produced no detectable amount of free radicals. For distilled water absorption of free radicals, cigarettes A (0.93 g) and B (1.04 g) produced no detectable amount of free radicals.

EXAMPLE 2

The experiments reported in this example were performed to determine the nicotine and N-methyl-2-(3-pyridyl)5-pyrrolidone (nicotine metabolite) concentration in the serum of smokers of various amounts of Daqianmeng (DQM) tobacco cigarettes (Shanghai, PRC) and cigarettes in accordance with the invention.

Analytical Procedure

Forty six (46) men, age 30, participated in this study each day for one week. Ten (group 1) smoked the cigarettes of the invention (30/day), containing a mixture of *Laurus nobilis* and *Nelumbo garetin* (2:1 w/w ratio). The remaining thirty six men (group 2) were divided into 6 subgroups (groups 2a–2f) of 6 men each. The individuals in each subgroup smoked the commercially available DQM cigarettes as follows: group 2a(less than 10/day), group 2b(19/day), group 2c(29/day), group 2d(39/day), group 2e(40/day) and group 2f(more than 50/day).

Venous blood samples (1 ml) were drawn from each individual in the study within one hour after the last cigarette was smoked. The samples were then individually diluted with 0.1N $NaHCO_3$(2.0 ml) and centrifuged to provide a serum supernatant. The diluted serum supernatant was heated over a steam bath(45 min.) and then cooled to room temperature. An aliquot of the diluted serum supernatant (100 ul) from each individual was then injected at room temperature onto a Shimadzu GC-16A gas chromatography column to detect the content and concentration of nicotine and its metabolites using the gas chromatography column in accordance with the manufactures instructions and standard procedures.

Results

Table 1 summarizes the data observed from these experiments. Each value listed in Table 1 is the average value of 6 measurements.

TABLE 1

Nicotine and Nicotine Metabolite Concentrations

| Cigarettes/day | Nicotine (ng/100 ml) | Metabolite (ng/100 ml) |
|---|---|---|
| <10 | 17.5 ± 2.1 | 186.0 ± 5.0 |
| 19 | 20.6 ± 1.7 | 223.0 ± 23.2 |
| 29 | 34.7 ± 5.5 | 251.2 ± 13.0 |
| 39 | 27.2 ± 2.1 | 300 ± 19.1 |
| 40 | 28.6 ± 2.0 | 320 ± 24.1 |
| >50 | 24.7 ± 3.0 | 248.5 ± 25.8 |

The results of this study show that the cigarettes of the invention produced no detectable amount of nicotine or its metabolites. Detectable amounts of nicotine and its metabolites were found in each of the 6 groups of where the DQM tobacco cigarettes were smoked. The nicotine content was found to be highest in the individuals of group 2c(29 cigarettes/day). The concentrations of nicotine and its metabolites were found to be proportional to the number of cigarettes per day up to a level of 50/day, at which point the observed concentrations began to decrease.

EXAMPLE 3

The experiments reported here compared the concentration of a variety of components in DQM tobacco cigarettes and non-tobacco cigarettes of the invention (*Laurus nobilis:Nelumbo garetin*=3:1).

Analytical Procedure

A sample (1.0 g) from each cigarette was burned in the presence of oxygen in a combustion chamber. The gases were drawn off through a series of three absorption tubes containing 0.1N sodium hydroxide in water (5 ml), benzene (5 ml) and cyclohexane (5 ml), respectively. Once combustion was completed, the three absorption solutions from each sample were combined to provide a combined absorption solution(15 ml). Aliquots (50 ul each) of the combined solution from each sample was injected onto a Shimidazu GC-16A chromatography column for gas chromatographic analysis of carbon monoxide and onto a Walters HPLC/481-UV column for gas chromatographic analysis of dibenzanthracene level.

Results

The results obtained by these experiments are reported in Table 2.

TABLE 2

| Harmful Contents After Combustion | | |
|---|---|---|
| Component | Commercial | Invention |
| Carbon monoxide (ug/g) | 13.0 ± 6.0 | 6.0 ± 4.0 |
| Dibenzanthracene (ng/g) | 31.0 ± 8.0 | 5.6 ± 3.0 |
| Benzopyrene (ng/g) | 11.2 ± 1.0 | 8.4 ± 2.0 |

As shown in Table 2, the composition of the invention produced very low levels of the above harmful substances, such as carbon monoxide and dibenzanthracene, whereas their levels are many times higher in the commercially available tobacco-containing cigarettes tested.

What is claimed is:

1. A composition which comprises a dried preparation suitable for smoking of a plant selected from the group consisting of *Laurus nobilis* and *Nelumbo garetin* wherein the preparation resembles cut cigarette filler tobacco, cut pipe tobacco or cut cigar filler tobacco.

2. The composition of claim 1 wherein the plant is *Laurus nobilis*.

3. The composition of claim 1 wherein the plant is *Nelumbo garetin*.

4. The composition of claim 1 which includes a mixture of dried preparations of *Laurus nobilis* and *Nelumbo garetin*.

5. The composition of claim 4 wherein the *Laurus nobilis* and *Nelumbo garetin* preparations are combined in a proportion of from about 1:1 to 4:1.

6. The composition of claim 1 which further comprises an extract of at least one plant selected from the group consisting of *Polygonum Multiform Thung, Schisandra Chinesis Baill, Salvia Miltiorrhiza*, ginseng, *Umbilicaria Esculenta Minks, Atractylodes Macrocephala Koids, Lycium Chinense Mill*, and *Astragalus Membranaceus*.

7. The composition of claim 1 which further comprises honey.

8. The composition of claim 1 wherein the dried preparation is a preparation comprising leaves of a plant selected from the group consisting of *Laurus nobilis* and *Nelumbo garetin*.

9. The composition of claim 1 wherein the dried preparation is a preparation comprising leaves of a plant selected from the group consisting of *Laurus nobilis* and *Nelumbo garetin* that have been subjected for at least eight hours at a temperature of from about 100° C. to about 120° C.

10. A composition which comprises (a) the composition of claim 1 and (b) a tobacco-containing smoking composition.

11. The composition of claim 10 wherein (a) and (b) are present in a weight ratio of about 10:1 to 1:10.

12. The composition of claim 11 wherein the ratio is about 5:1 to 1:5.

13. The composition of claim 10 wherein (a) comprises a dried preparation suitable for smoking of *Laurus nobilis*.

14. The composition of claim 10 wherein (a) comprises a dried preparation suitable for smoking of *Nelumbo garetin*.

15. The composition of claim 10 wherein (a) comprises a mixture of dried preparations of *Laurus nobilis* and *Nelumbo garetin*.

16. The composition of claim 10 wherein (a) further comprises an extract of a plant selected from the group consisting of *Polygonum Multiform Thung, Schisandra Chinensis Baill, Salvia Miltiorrhiza*, ginseng, *Umbilicaria Esculenta Minks, Atractylodes Macrocephala Koids, Lycium Chinense Mill*, and *Astragalus Membranaceus*.

17. The composition of claim 10 wherein (a ) further comprises honey.

18. The composition of claim 10 wherein (a) comprises a dried preparation suitable for smoking of the leaves of a plant selected from the group consisting of *Laurus nobilis* and *Nelumbo garetin*.

19. The composition of claim 10 wherein (a) is a preparation of a plant selected from the group consisting of *Laurus nobilis* and *Nelumbo garetin* that have been subjected for at least eight hours at a temperature of from about 100° C. to about 120° C.

20. The composition of claim 10 wherein (a) is a preparation of the leaves of a plant selected from the group consisting of *Laurus nobilis* and *Nelumbo garetin* that have been subjected for at least eight hours at a temperature of from about 100° C. to about 120° C.

* * * * *